US007326104B2

(12) United States Patent
Tung et al.

(10) Patent No.: US 7,326,104 B2
(45) Date of Patent: Feb. 5, 2008

(54) APPARATUS FOR HOLDING LENSES AND METHOD FOR USE THEREOF

(75) Inventors: Tsai-Shih Tung, Tu-Cheng (TW); Hsin-Ho Lee, Tu-Cheng (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,815

(22) Filed: Oct. 3, 2006

(65) Prior Publication Data

US 2007/0155291 A1 Jul. 5, 2007

(30) Foreign Application Priority Data

Dec. 30, 2005 (CN) ..... 2005 1 0121397

(51) Int. Cl.
*B24B 1/00* (2006.01)

(52) U.S. Cl. ..... 451/57; 451/384; 451/388

(58) Field of Classification Search ..... 451/42–44, 451/57, 367, 374, 384, 388, 390
See application file for complete search history.

(56) References Cited

U.S. PATENT DOCUMENTS

| | | | | |
|---|---|---|---|---|
| 2,688,220 | A * | 9/1954 | Boutell | 451/388 |
| 3,994,101 | A * | 11/1976 | Coburn et al. | 451/388 |
| 4,669,226 | A * | 6/1987 | Mandler | 451/384 |
| 6,623,339 | B1 | 9/2003 | Igarashi et al. | |
| 6,855,036 | B1 * | 2/2005 | Arserio et al. | 451/42 |

* cited by examiner

*Primary Examiner*—Dung Van Nguyen
(74) *Attorney, Agent, or Firm*—Jeffrey T. Knapp

(57) ABSTRACT

An apparatus for holding a plurality of lenses, including: a block having a mounting surface; a cavity defined in the block at the mounting surface; and a through hole defined in the block, the through hole being in communication with the cavity, wherein the mounting surface is configured for mounting of the lenses thereon whereby the lenses cooperatively substantially close the cavity at the mounting surface. Because of the cavity has a vacuum therein, the lenses can be retainable attached on the mounting surface by means of the vacuum.

8 Claims, 11 Drawing Sheets

APPARATUS FOR HOLDING LENSES AND METHOD FOR USE THEREOF

1. TECHNICAL FIELD

The present invention relates to an apparatus for holding a plurality of lenses and a method for using the apparatus.

2. DISCUSSION OF RELATED ART

Referring to FIGS. 7 to 11, a method for grinding quadrate lenses includes the steps of: assembling a number of quadrate lenses 1 to form a lens assembly 10 (see FIG. 7); placing the lens assembly 10 in a V-shaped recess 32 of a lens holder 30 (see FIG. 10) and fixing the lens assembly 10 in the lens holder 30; grinding off an unnecessary first portion of the lenses to form a semi-processed lens assembly 20 (FIG. 8) using a roller machine; placing the semi-processed lens assembly 20 in an arc-shaped recess 42 of a work holder 40 (see FIG. 11); grinding off an unnecessary second portion of the lenses to obtain a number of rounded lenses as shown in FIG. 9.

In the above method, the lens assembly 10 must be fixed on the V-shaped recess 32 of the lens holder 30 because of the shearing force produced when the roller machine is working. Conventional methods for fixing the lenses 1 generally include the following two methods. One method is providing a locking device arranged at two distal ends of the V-shaped recess 32 of the lens holder 30. The lenses 1 can be fixed on the V-shaped recess 32 by a locking force from the locking device. However, it is difficult for the locking device to exert enough locking force to lock multiple lenses 1. The other method is coating UV glue between each lens 1 and on the V-shaped recess 32 so that the lenses 1 can be attached to the V-shaped recess 32. However, the method using UV glue requires a step of removing the UV glue after processing to release the lenses 1 thus requiring more time and more steps.

What is needed, therefore, is an apparatus for holding a plurality of lenses and a method for using it.

SUMMARY

An apparatus for holding a plurality of lenses according to a preferred embodiment includes: a block having a mounting surface; a cavity defined in the block at the mounting surface; and a through hole defined in the block, the through hole being in communication with the cavity, wherein the mounting surface is configured (i.e., structured and arranged) for mounting of the lenses thereon whereby the lenses cooperatively substantially close the cavity at the mounting surface.

Another preferred embodiment of the invention provides a method for using the apparatus for holding a plurality of lenses, the method comprises the steps of: providing an apparatus as detailed above; aligning and attaching a plurality of lenses to each other thereby forming a lens assembly; mounting the lens assembly on the mounting surface in a manner such that the lens assembly substantially closes the cavity at the mounting surface; and evacuating the cavity through the through hole to create a vacuum in the cavity, whereby the lens assembly is retainable attached to the mounting surface.

Other advantages and novel features will become more apparent from the following detailed description when taken in conjunction with the accompanying drawings.

BRIEF DESCRIPTION OF THE DRAWINGS

The components in the drawings are not necessarily to scale, the emphasis instead being placed upon clearly illustrating the principles of the present apparatus and method. Moreover, in the drawings, like reference numerals designate corresponding parts throughout the several views.

DETAILED DESCRIPTION OF PREFERRED EMBODIMENTS

Figure 1:
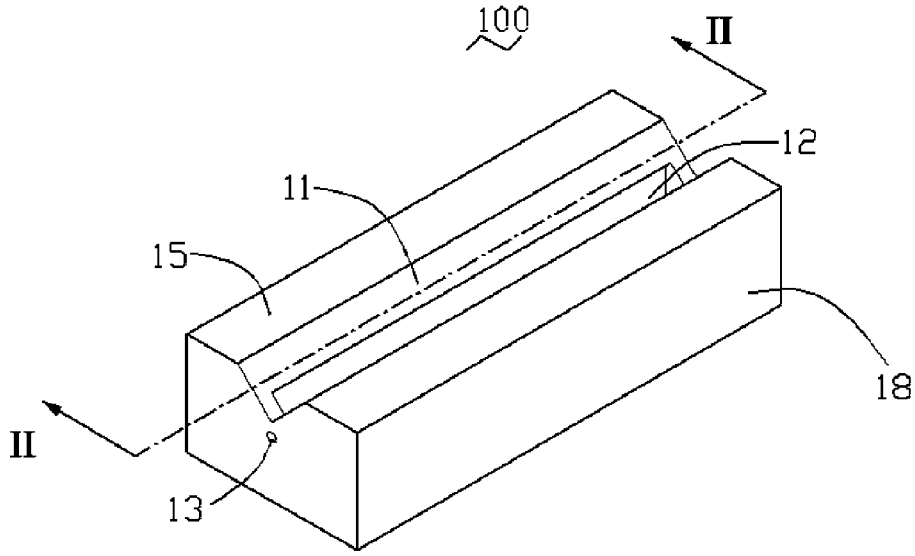
FIG. 1 is a schematic, isometric view of an apparatus for holding lenses according to a first preferred embodiment.
Figure 2:
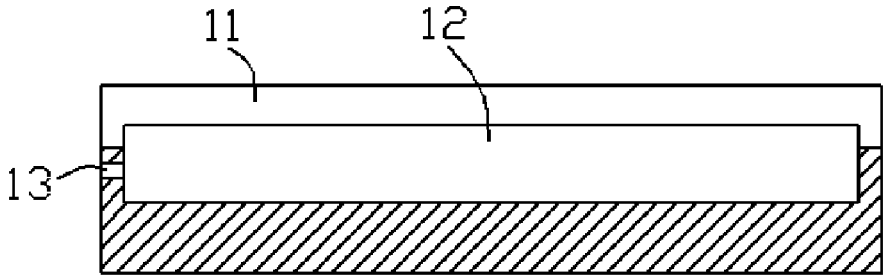
FIG. 2 is a sectional view of the apparatus, taken along line 11-11 of FIG. 1.

Referring to FIGS. 1 to 2, an apparatus 100 for holding a plurality of lenses in accordance with a first preferred embodiment is shown. The present apparatus 100 generally has a block 18 that includes a mounting surface 15 that is configured (i.e., structured and arranged) for mounting of the lenses thereon, the mounting surface 15 defines an elongated recess 11 extending along a lengthwise direction of the block 18. The elongated recess 11 is configured for allowing the lenses to be placed therein. An elongated cavity 12 is defined in the block 18 at the mounting surface 15, the elongated cavity 12 extending along a direction substantially coinciding with that of the elongated recess 11. A through hole 13 is defined in the block 18, and the through hole 13 is in communication with the elongated cavity 12. The lenses can cooperatively substantially close the elongated cavity 12 at the mounting surface 15 when the whole length of the lenses is equal to or larger than the length of the elongated recess 11. In the first embodiment, the elongated cavity 12 is in communication with the middle of elongated recess 11. The through hole 13 is in communication with a vacuum pump (not shown) configured for evacuating the cavity 12 so as to create a vacuum therein, so that pressure of the cavity 12 is less than that out of the cavity 12, whereby the lenses are retainably attached on the mounting surface 15 by means of the vacuum.

The recess 11 could have a cross section selected from the group consisting of an arc-shaped cross section, a U-shaped cross section, a V-shaped cross section or other types so long as the lenses can be retainable received in the recess 11.

Figure 3:
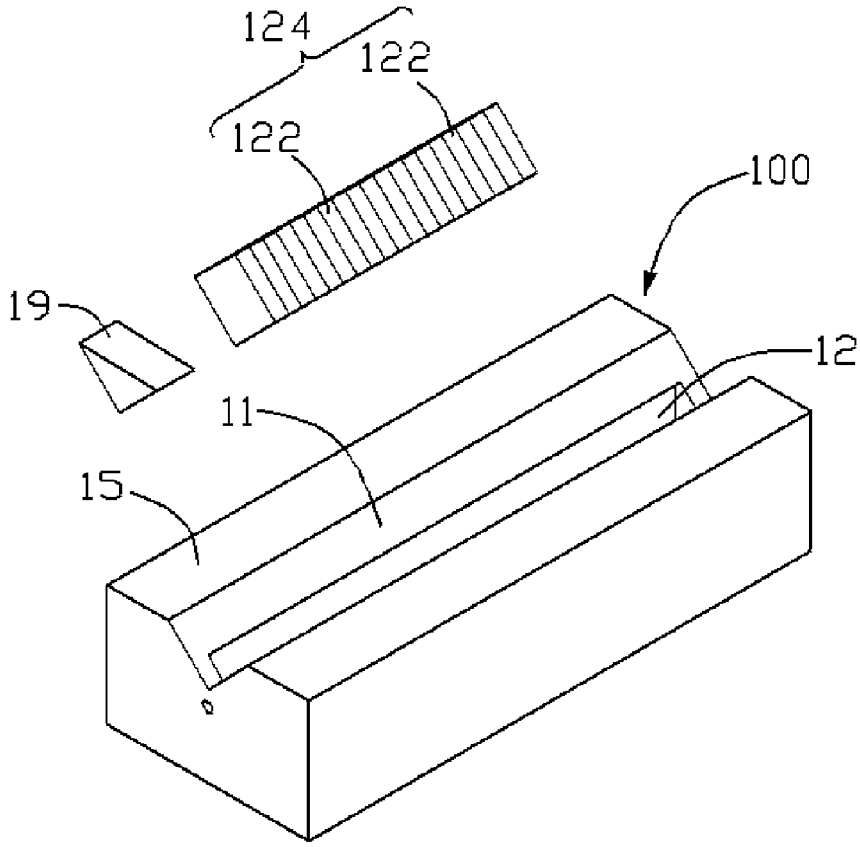
FIG. 3 is similar to FIG. 1, but also showing a sealing member and a lens assembly to be mounted on the apparatus.

Referring to FIG. 3, a lens assembly 124 formed by aligning and attaching a plurality of lenses 122, the apparatus 100 further includes a sealing member 19 having a shape mating with the mounting surface 15 in a manner such that the sealing member 19 and the lenses cooperatively substantially close the cavity 12 at the mounting surface 15 when the length of the lens assembly 124 is less than the length of the recess 11. The sealing member 19 may be attached to the end of lens assembly 124 and be received in the recess 11, wherein the sealing member 19 together with the lens assembly 124 can be pressed firmly against the cavity 12 at the mounting surface 15. The air is removed by the vacuum pump from the cavity 12 and the pressure of the cavity 12 is less than that out of the cavity 12, so the lens assembly 124 can be sucked firmly against the cavity 12 at the mounting surface 15.

Figure 4:
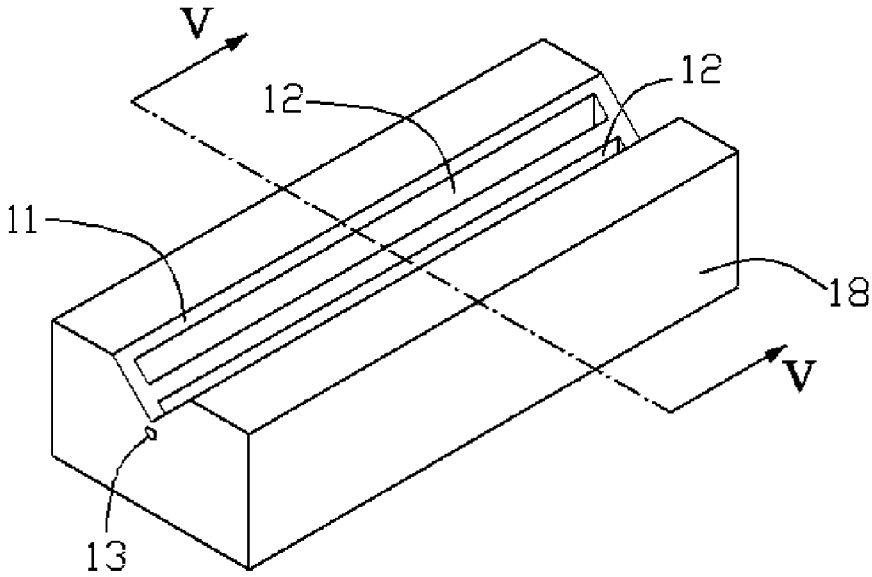
FIG. 4 is a schematic, isometric view of an apparatus for holding lenses according to a second preferred embodiment.
Figure 5:
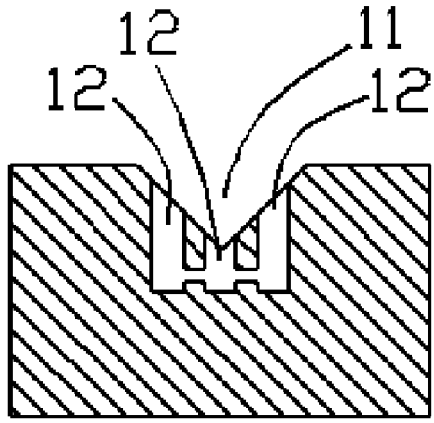
FIG. 5 is a sectional view of the apparatus, taken along line V-V of FIG. 4.
Figure 6:
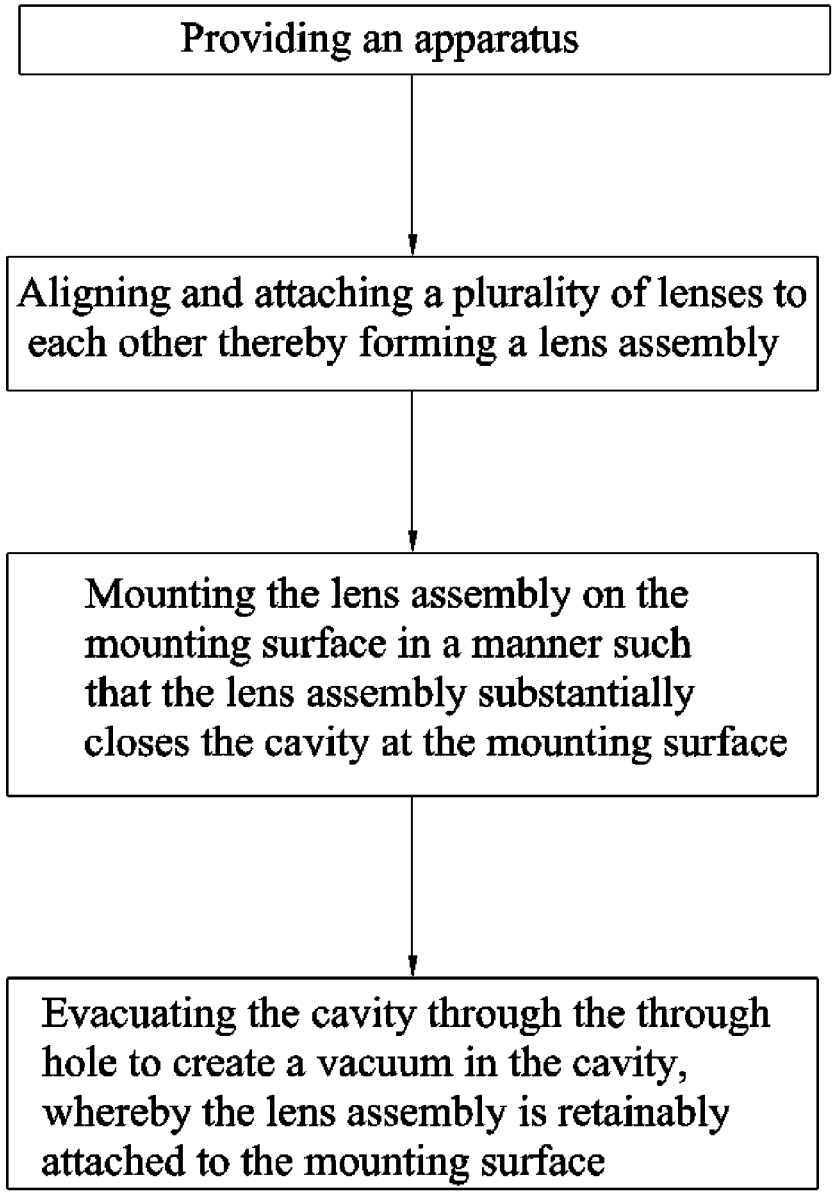
FIG. 6 is a flowchart of a method for using the apparatus according to a third preferred embodiment.
Figure 7:
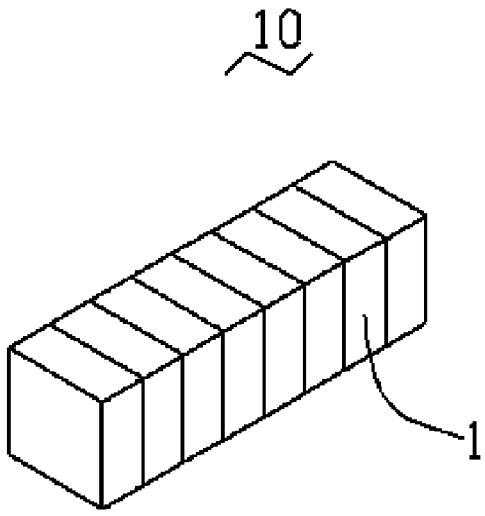
FIG. 7 (RELATED ART)
FIG. 7 is an isometric view of a conventional lens assembly.
Figure 8:
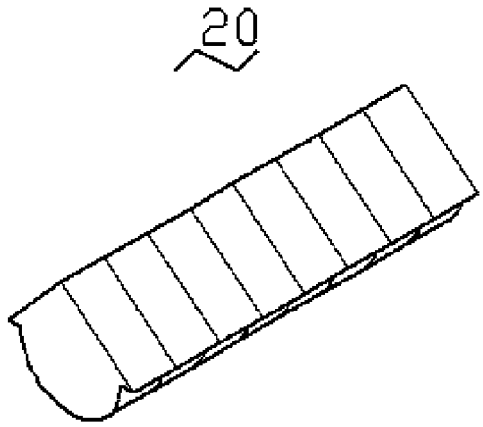
FIG. 8 (RELATED ART)
FIG. 8 is an isometric view of a semi-finished lens assembly of FIG. 7.
Figure 9:
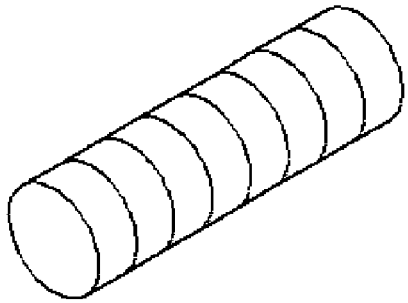
FIG. 9 (RELATED ART)
FIG. 9 is an isometric view of a finished lens assembly of FIG. 7.
Figure 10:
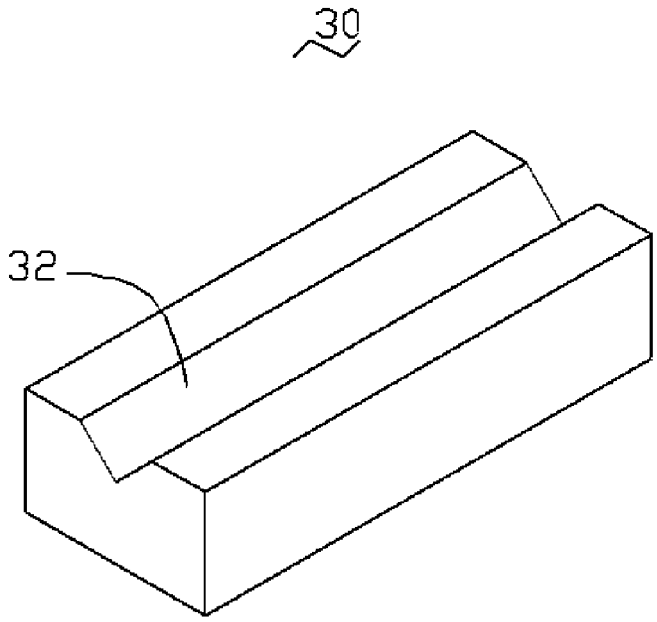
FIG. 10 (RELATED ART)
FIG. 10 is an isometric view of a conventional lens holder.
Figure 11:
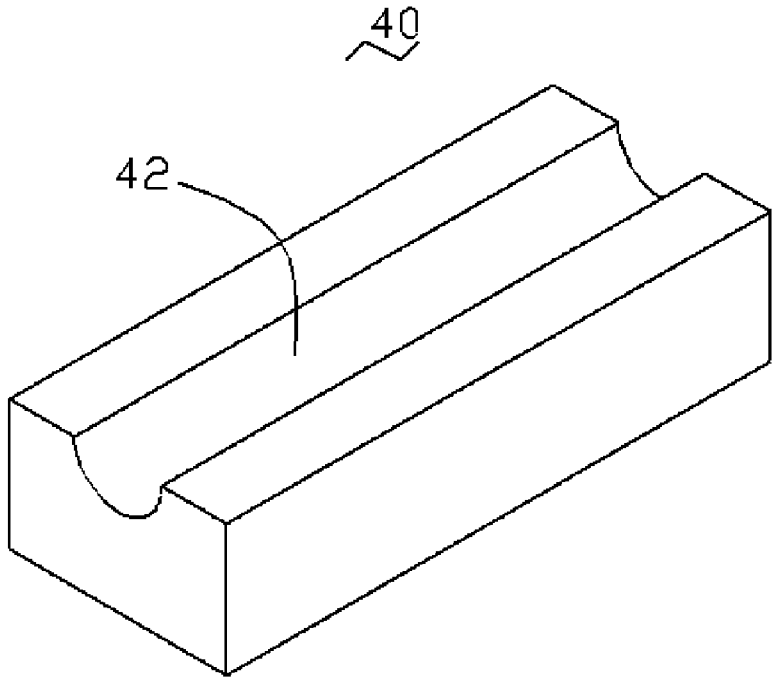
FIG. 11 (RELATED ART)
FIG. 11 is an isometric view of another conventional lens holder.

Referring to FIGS. 4 to 5, an apparatus 200 in accordance with a second preferred embodiment of the present invention is the same as the first embodiment, except that the cavity 12 has a plurality of openings arranged symmetrically at the mounting surface 15. In the second embodiment, some different portions of the lens assembly 124 can be sucked firmly against the cavity 12 at the mounting surface 15 by a uniform force.

Referring to FIGS. 1 to 3, and FIG. 6, a method for using the apparatus 100 in accordance with a third embodiment is shown. The method includes the following steps.

Step 1: providing an apparatus 100 as described above.

Step 2: aligning and attaching a plurality of lenses 122 to each other thereby forming a lens assembly 124, and mounting the lens assembly 124 on the mounting surface 15 in a manner such that the lens assembly 124 is placed in the elongated recess 11 and substantially closes the cavity 12 at the mounting surface 15.

The lens 122 may be a quadrate lens, polygonal lens and arc-shaped lens and so on, wherein shape of the recess 11 must be engaged with the lens so the lenses can be retainable attached on the mounting surface 15.

Step 3: evacuating the cavity 12 through the through hole 13 to create a vacuum in the cavity 12, the lens assembly 124 can cooperatively substantially close the cavity 12 at the mounting surface 15.

A pressure difference between the inside and outside of the cavity 12 could form a uniform holding force on the lens assembly 124. The lens assembly 124 can be pressed firmly against the cavity 12 by holding force. Every lens 122 at the mounting surface 15 can be held on the cavity 12 by a uniform force. The pressure of the cavity 12 is determined by size of the lens assembly 124. In this embodiment it is easy to control the pressure of the cavity 12 by using the vacuum pump, so the embodiment can provide enough force to hold the lenses 122 against the cavity 12.

Re-pressurizing the pressure of cavity 12 and taking away the lenses 122 after processing for the lens assembly 124.

If the length of the lens assembly 124 is less than the length of the recess 11, in this method the apparatus 100 need to use a sealing member 19 having a shape mating with the mounting surface 15 in a manner such that the sealing member 19 and the lenses cooperatively substantially close the cavity 12 at the mounting surface 15. The sealing member 19 may be attached to the end of lens assembly 124 and be received in the recess 11, wherein the sealing member 19 together with the lens assembly 124 can be pressed firmly against the cavity 12 at the mounting surface 15.

In this embodiment, the method as detailed above does not require adhesive to attach the lenses in the apparatus 100, so the method use less steps and thus less time than the conventional method.

It is understood that the various above-described embodiments and methods are intended to illustrate rather than limit the invention. Variations may be made to the embodiments and methods without departing from the spirit of the invention. Accordingly, it is appropriate that the appended claims be construed broadly and in a manner consistent with the scope of the invention.

What is claimed is:

1. An apparatus for holding a lens assembly formed by aligning and attaching a plurality of lenses, comprising:

a block comprising:

a mounting surface defining an elongated recess extending along a lengthwise direction of the block, the elongated recess being configured for allowing the lens assembly to be placed therein, an elongated cavity defined in the block at the mounting surface, the elongated cavity extending along a direction substantially coinciding with that of the elongated recess, and a through hole defined in the block, the through hole being in communication with the elongated cavity, wherein the mounting surface is configured for mounting of the lens assembly thereon whereby the lens assembly can cooperatively substantially close the elongated cavity at the mounting surface.

2. The apparatus of claim 1, further comprising a sealing member having a shape mating with the elongated recess of the mounting surface in a manner such that the sealing member and the lens assembly can cooperatively substantially close the cavity at the mounting surface.

3. The apparatus of claim 2, wherein the elongated cavity has a plurality of openings at the mounting surface.

4. The apparatus of claim 2, wherein the openings are arranged symmetrically at the mounting surface.

5. The apparatus of claim 1, wherein the elongated recess has a cross section selected from the group consisting of an arc-shaped cross section, a U-shaped cross section and a V-shaped cross section.

6. The apparatus of claim 1, further comprising a vacuum pump configured for evacuating the elongated cavity so as to create a vacuum therein, whereby the lens assembly can be retainable attached on the mounting surface by means of the vacuum.

7. A method for using an apparatus for holding a plurality of lenses, comprising the steps of:

providing an apparatus of claim 1;

aligning and attaching the plurality of lenses to each other thereby forming a lens assembly;

mounting the lens assembly on the mounting surface in a manner such that the lens assembly is placed in the elongated recess and substantially closes the cavity at the mounting surface; and evacuating the cavity through the through hole to create a vacuum in the cavity, whereby the lens assembly can be retainably attached to the mounting surface.

8. The method of claim 7, further comprising the steps of providing a sealing member having a shape mating with the elongated recess of mounting surface, mounting the sealing member and the lenses lens assembly on the mounting surface in a manner such that the sealing member and the lens assembly cooperatively substantially close the elongated cavity at the mounting surface.

* * * * *